US005454329A

United States Patent [19]

Liprandi et al.

[11] Patent Number: 5,454,329

[45] Date of Patent: Oct. 3, 1995

[54] ANTICENTRIFUGAL ACTIVE LATERAL SUSPENSION FOR RAILWAY VEHICLES

[75] Inventors: Giorgio Liprandi, Savigliano; Alberto Magnani; Gaetano Costantini, both of Torin; Luciano Gerbaudo, Savigliano, all of Italy

[73] Assignee: Fiat Ferroviaria Spa, Torino, Italy

[21] Appl. No.: 134,903

[22] Filed: Oct. 13, 1993

[30] Foreign Application Priority Data

Mar. 19, 1993 [IT] Italy ..... TO93A0186

[51] Int. Cl.[6] ..... B61F 5/22

[52] U.S. Cl. ..... 105/199.2; 105/171

[58] Field of Search ..... 105/171, 185, 105/193, 201; 280/112.2

[56] References Cited

U.S. PATENT DOCUMENTS

| | | | |
|---|---|---|---|
| 3,977,694 | 8/1976 | Nordstrom | 105/199.2 X |
| 4,069,767 | 1/1978 | Glaze | 105/199.2 X |
| 4,440,093 | 4/1984 | Kakehi et al. | 105/199.2 X |
| 4,715,289 | 12/1987 | Okamoto et al. | 105/199.2 |
| 5,170,716 | 12/1992 | Durand et al. | 105/199.2 |

FOREIGN PATENT DOCUMENTS

| | | |
|---|---|---|
| 0032158 | 7/1981 | European Pat. Off. . |
| 0128126 | 12/1984 | European Pat. Off. . |
| 0271592 | 6/1988 | European Pat. Off. . |
| 9220559 | 11/1992 | United Kingdom . |

*Primary Examiner*—Robert J. Oberleitner
*Assistant Examiner*—S. Joseph Morano
*Attorney, Agent, or Firm*—Sughrue, Mion, Zinn, Macpeak & Seas

[57] ABSTRACT

Anticentrifugal active lateral suspension apparatus for balancing the non-compensated centrifugal acceleration along a curve of a railway vehicle, including fluid pressure jacks, interposed transversely between the body and the opposite sides of each bogie, vales for connecting alternatively the jacks with a source of fluid under pressure, and transducers adapted to detect the non-compensated centrifugal acceleration and to generate corresponding piloting signals for the valves so as to apply, by the jacks, a force contrasting the centrifugal force acting on the body. The transducers comprise two accelerometers placed in proximity of the opposite ends of the vehicle and whose signals are supplied to an electronic processing unit arranged selectively to pilot the vales in different modes. The valves are electronic servo valves or proportional valves.

9 Claims, 2 Drawing Sheets

ANTICENTRIFUGAL ACTIVE LATERAL SUSPENSION FOR RAILWAY VEHICLES

BACKGROUND OF THE INVENTION

The present invention is related to an anticentrifugal active lateral suspension apparatus for railway vehicles comprising a body, two bogies placed in proximity of the body ends and vertical and lateral suspension means between the body and the two bogies, wherein the said apparatus comprises means for balancing the non-compensated centrifugal acceleration along a railway curve, including fluid pressure jacks interposed transversally between the body and the opposite sides of each bogie, valve means for connecting alternatively said jacks with a source of fluid under pressure, and transducer means for detecting the non-compensated centrifugal acceleration and generating corresponding piloting signals for the said valve means so as to apply, by means of the said jacks, a force contrasting the centrifugal force acting on the body.

Known apparatuses of the above mentioned type, currently installed on board railway vehicles with anticentrifugal lateral suspension, employ generally complex and scarcely reliable transducers, and related control systems which are quite approximative as far as the piloting operations of the valve means by the piloting signals are concerned, in terms both of amount and promptness of adjustment. Moreover, those systems are hugely and negatively affected by the jerks of the vehicle during travel.

SUMMARY OF THE INVENTION

The object of the present invention is to provide an apparatus of the type defined at the beginning, which enables effective balancing of the non-compensated centrifugal force along a curve, so as to perform a centering effect of the body relative to the bogies and thus preventing yielding of the lateral suspension and consequent lateral bumping, thereby ensuring good travel comfort even at high speed along a curve, and independently of jerks of the bogies.

A further object of the invention is to improve accuracy and timeliness of the contrasting transverse force applied to the vehicle body by the anticentrifugal balancing means.

Still a further object of the invention is to provide a high degree of application flexibility of the apparatus, due to the possibility of selectively modifying the kind of intervention thereof even as a function of the specific features of the vehicle and of the railway.

According to the invention, the above objects are achieved by virtue of the fact that the said transducer means comprise two accelerometers placed in proximity of the opposite ends of the vehicle, and of the fact that the respective signals are fed to an electronic processing unit adapted to generate electrical signals proportional to the non-compensated centrifugal acceleration for piloting the said valve means.

The valve means conveniently include an electronic valve such as a "servo valve", or alternatively such as a "proportional valve", which produces in the said jacks a pressure proportional to the piloting electronic signal coming from the said processing unit, thereby increasing or decreasing the pressure with a minimum delay with respect to corresponding increase or decrease of the electronic signal.

The electronic processing unit is adapted to be set so as to pilot the said valve means selectively according to one or the other of the following modes:

- the piloting signals of the valve means associated to the jacks of each bogie are solely a function of the signal provided by the accelerometer placed at the end of the vehicle corresponding to the respective bogie,
- the piloting signals of the valve means associated to the jacks of the two bogies are a function of a weighted average value of the signals provided by the accelerometers.

The accelerometers may be placed directly at the opposite ends of the vehicle, or onto the two bogies. In either case the signals generated thereby are processed by the electronic processing unit so as to produce an electrical signal proportional to the centrifugal force.

The valve means (servo valves or proportional valves) feed to the jacks a pressure proportional to the electric signal and of an amount such as to oppose the centrifugal force. By increasing or decreasing the pressure at high speed it is avoided that the jacks remain rigid, which enables, during travel of the railway vehicle provided with the apparatus according to the invention, avoiding jerks of the body.

The disposition of the two accelerometers and the processing of the respective outputs allow, according to the invention, to adjust the sensibility of the anticentrifugal active lateral suspension system, so as to optimize same as a function of the demands of use. Thus, according to the above first setting mode of the electronic processing unit, it is possible to obtain a differential intervention of the jacks associated to the one and the other of the vehicle bogies, and in particular to anticipate the intervention of that corresponding to the end of the vehicle which is firstly subject to curve inscription.

In the second setting mode of the electronic processing unit, instead, it is annulled the delay of intervention of the jacks associated to the bogie which follows curve inscription of the vehicle.

In either case, for the generation of the electric piloting signals to the valves it is possible to weight and mix the signals of each accelerometer in the way which is most convenient with respect to the railway vehicle characteristics.

For instance, the electronic processing unit is adapted to be further set so as to pilot the said valve means selectively according to one or the other of the following additional modes:

- the piloting signals of the valve means associated to the jacks of the two bogies are both a function of the signals provided by the accelerometer placed on one of the vehicle ends,
- the piloting signals of the valve means associated to the jacks of the two bogies are both a function of the signals provided by the accelerometer placed on the other vehicle end.

In this way the promptness of response of the anticentrifugal active lateral system can be normally increased, in case it is employed the signal of the accelerometer corresponding to the bogie which firstly is inscribed along the curve, or decreased when the signals provided by the accelerometer corresponding to the bogie which follows inscription along the curve are employed.

In any case the system is perfectly reversible and can be thus used, possibly modifying the setting of the electroning processing unit, in both directions of travel of the vehicle.

BRIEF DESCRIPTION OF THE DRAWINGS

The invention will now be disclosed in detail with reference to the annexed drawings, provided purely by way of non-limiting example, wherein.

DETAILED DESCRIPTION OF THE INVENTION

Figure 1:
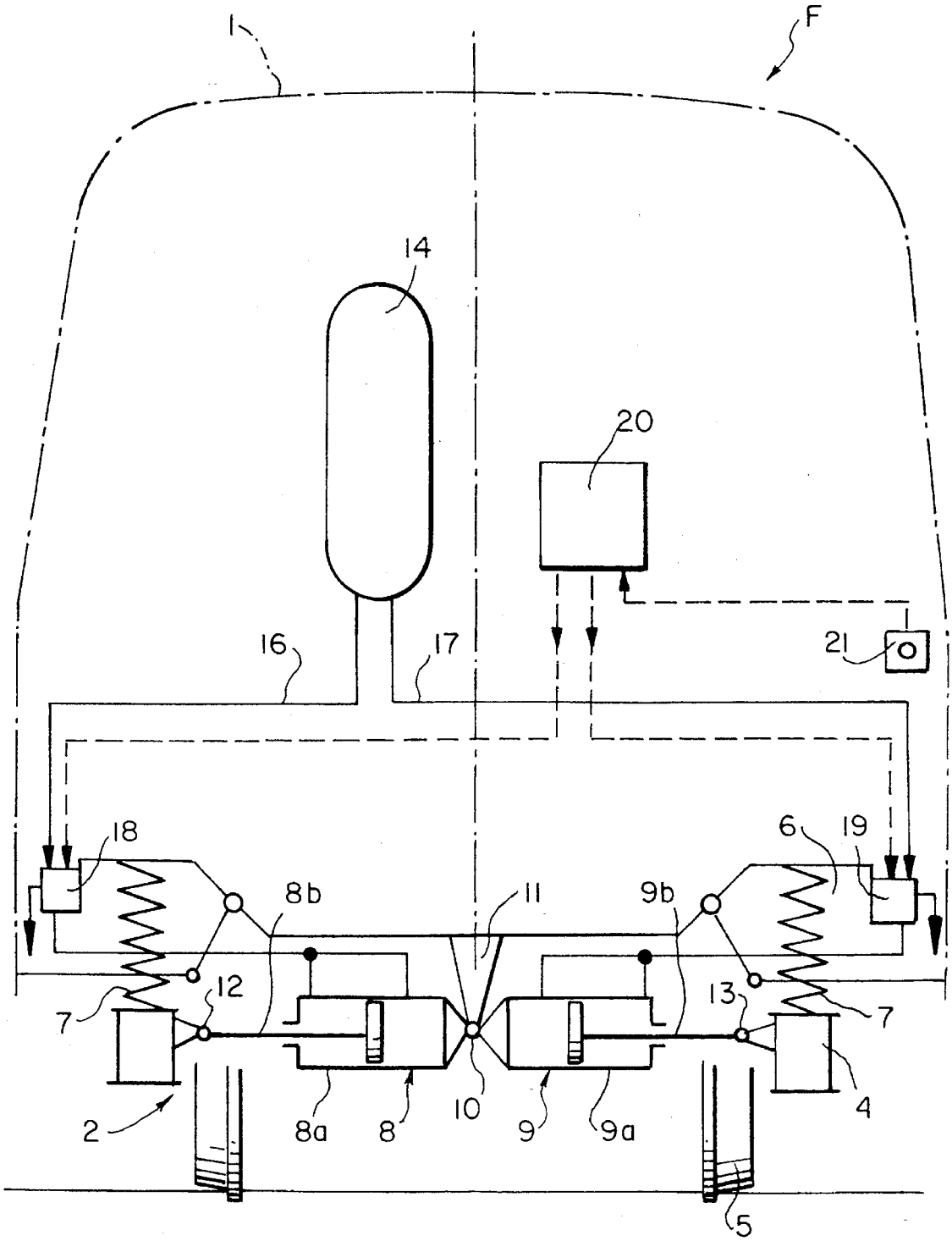
FIG. 1 is a diagrammatic cross-sectional view of a railway vehicle having an anticentrifugal active lateral suspension according to the invention, the cross section being taken in correspondence of one of the vehicle bogies.
Figure 2:
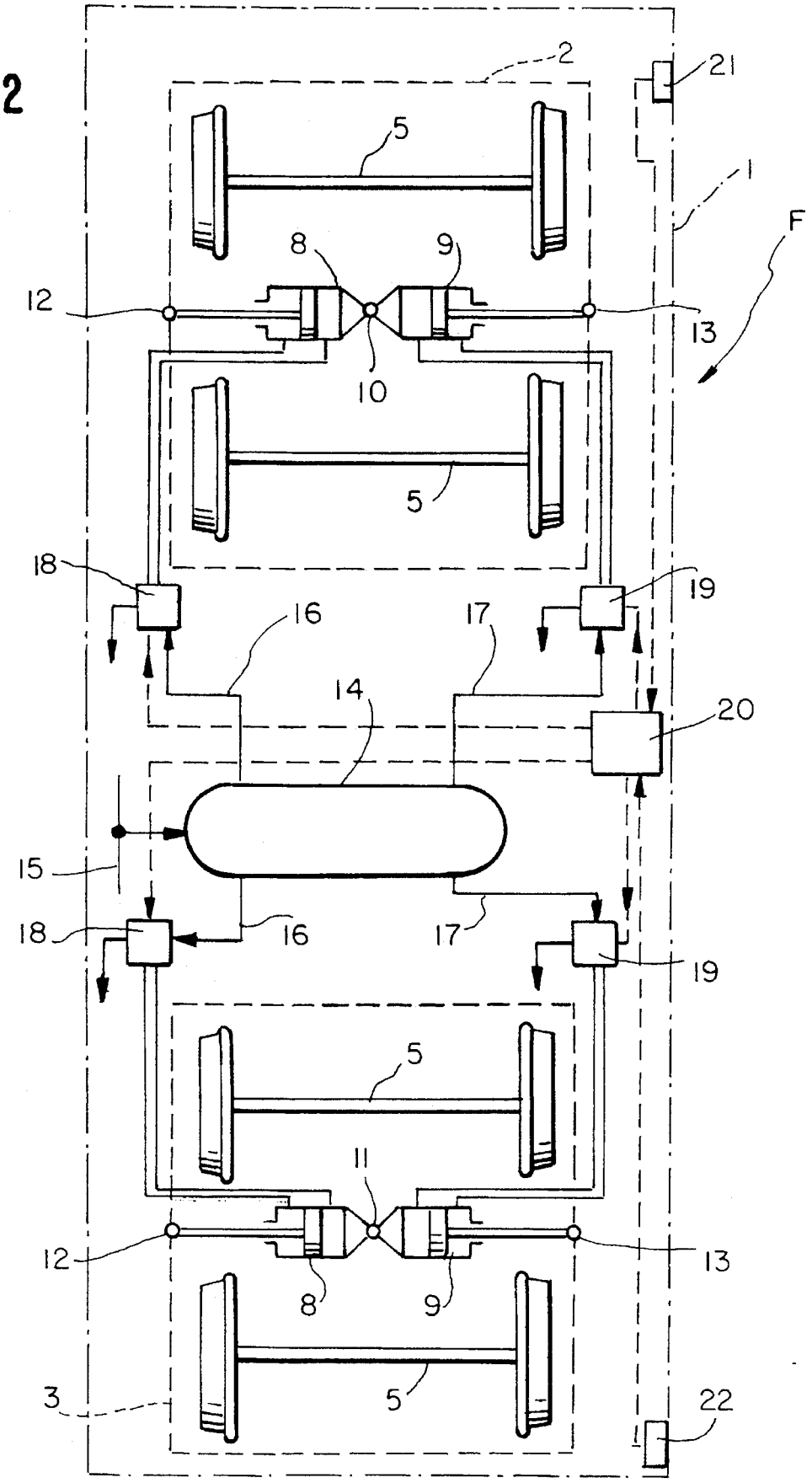
FIG. 2 is a diagrammatic top plan view of the railway vehicle of FIG. 1.

Referring to the drawings, a railway vehicle F essentially comprises a body 1 supported in proximity to the ends thereof by two bogies 2, 3, each comprising, in a way known per se, a frame 4, two axles 5 and a swinging transverse member 6. The swinging transverse members 6 are carried on the bogies 2, 3 substantially in correspondence of the central transverse axis thereof, each with the interposition of vertical helical springs 7 defining the vertical and lateral secondary suspension of the vehicle.

The body 1 of the vehicle F is suspended onto the swinging transverse members 6, also in a way known per se.

Reverting now to the apparatus according to the invention, two opposed pneumatic jacks 8, 9 are placed within each of the bogies 2, 3, these jacks being placed below the respective swinging transverse element 6, parallel thereto. The two jacks 8,9 comprise respective cylinders 8*a*, 9*a* pivoted at 10 relative to a central lower appendage 11 of the swinging transverse member 6, and respective rods 8*b*, 9*b* articulated at 12, 13 to the opposite sides of the bogie frame 4.

The disposition of the two pairs of jacks 8, 9 is that the jacks of each pair are symmetrically placed on opposite sides with respect to the central appendage 11 of the swinging transverse 6.

The jacks 8, 9 are fed by a source of air under pressure constituted by a reservoir (or by two reservoirs) 14 supplied by an air duct 15. The reservoir 14 is connected, by means of respective input ducts 16, 17, with two electronic valves 18, which can be constituted by servo valves or by proportional valves, each associated to a respective jack 8, and with two electronic valves 19, also servo valves or alternatively proportional valves, each associated to a respective jack 9. The valves 18, 19 are constituted by electro-pneumatic pressure regulators controlled by an electronic processing unit generally indicated as 20. The electronic unit 20 is connected to a pair of accelerometric transducers 21, 22 placed in proximity to the areas of the vehicle F corresponding to the bogies 2, 3. In the case of the shown example, the two accelerometers 21, 22 are applied onto the ends of the body 1 of the vehicle F. Alternatively, such accelerometers 21, 22 may be directly applied onto the frames 4 of the bogies 2, 3.

The electronic processing unit 20 is provided, besides inputs for the electric connection with the accelerometers 21, 22, with four outputs through which piloting signals are delivered to the valves 18, 19 associated to the jacks 8, 9, of the bogies 2, 3, respectively.

The electronic unit 20 is provided with conditioning circuits, not shown in the drawings but within the knowledge of the man skilled in the art, so as to obtain the most favourable relationships between the inputs of the accelerometers 21, 22 and the outputs to the valves 18, 19. These relationships can be optimized as a function of the dynamic characteristics of the railway vehicle, according to what has been explained in the above.

In operation, when the vehicle F is travelling along a curve the accelerometers 21, 22 supply to the electronic processing unit 20 electrical signals indicative of the centrifugal acceleration non-compensated by the superelevation of the outer rail of the curve. These signals are conditioned by the unit 20 and then supplied to the proportional valves or servo valves 18, 19 which, as a function of the inputs received, adjust the pressure within the cylinders of the pneumatic jacks 8, 9.

In a way generally within the knowledge of the man skilled in the art, the operation of the unit 20 can be selectively set according to different modes, weighting and mixing the signals coming from the two accelerometers 21, 22, even as a function of the characteristics of the railway vehicle, for instance according to one or the other of the following modes:

- the piloting signals to the valve means (18, 19) associated to the jacks (8, 9) of each bogie (2, 3) are solely a function of the signals provided by the accelerometer placed at the end of the vehicle corresponding to the respective bogie (2, 3),
- the piloting signals of the valve means (18, 19) associated to the jacks (8, 9) of the two bogies (2, 3) are a function of a weighted average of the signals provided by both accelerometers (21, 22),
- the piloting signals of the valve means (18, 19) associated to the jacks (8, 9) of the two bogies (2, 3) are both a function of the signals provided by the accelerometer (21) placed at one end of the vehicle,
- the piloting signals of the valve means (18, 19) associated to the jacks (8, 9) of the two bogies (2, 3) are both a function of the signals provided by the accelerometer (22) placed on the other end of the vehicle.

In either one of the possible operating modes of the electronic unit 20, the valves 18, 19 control the supply of pressurized air to the jacks 8 or 9 placed outwardly with respect to the curve, so as to apply onto the appendages 11 of the swinging transverse members 6 a reaction directed inwardly to the curve, i.e. contrary to the direction of the centrifugal force, thus maintaining the swinging transverse members 6 and, therefore, the body 1 in a central position relative to the bogies 2, 3.

It will be apparent that the pressure acting within the jacks 8, 9 is depending upon the intensity of the centrifugal force not compensated by the rail superelevation along the curve, which is detected by the two accelerometers 21, 22, while the jerks are neutralized by the promptness of intervention of the proportional valves or servo valves 18, 19.

The position of the accelerometers 21, 22, placed as previously explained in proximity of the opposite ends of the vehicle F, and the possibility of selecting and setting different operating modes of the electronic unit 20, enable to improve the precision of intervention of the system, as well as to ensure a wide flexibility of use. It is also possible to obtain an intervention of the active lateral suspension in different times for the two bogies 2, 3, corresponding to the actual curve inscription firstly of one and subsequently of the other.

Alternatively, the intervention with respect to the two bogies 2, 3 can be even or it can be anticipated or, respectively, delayed to the moment of curve inscription of the forward bogie and of the rear bogie, with reference to the direction of travel, respectively.

Naturally the details of construction and the embodiments may be widely varied with respect to what has been disclosed and illustrated, without thereby departing from the scope of the present invention. Thus, while the invention has been described with reference to a vehicle with bogies provided with transverse swinging members, it can be equally applied to vehicles the body of which directly bears onto the secondary suspension. In this case obviously the jacks 8, 9 will be directly connected to the body, instead than to the tranverse members.

What we claim is:

1. An anticentrifugal active lateral suspension apparatus for railway vehicles comprising a body having opposite ends, two bogies placed in proximity of the body ends and having respective opposite sides, and vertical and lateral suspension means between the body and the two bogies, said apparatus including means for balancing non-compensated centrifugal acceleration during travel of the vehicle along a railway curve, comprising a source of fluid under pressure, fluid pressure jacks interposed transversely between the body and the opposite sides of each bogie, valve means for connecting alternatively said jacks with said source of fluid under pressure, and transducer means adapted to detect the non-compensate centrifugal acceleration and to produce corresponding piloting signals for said valve means so as to apply, by means of said jacks, a force contrasting the centrifugal force acting on the body, said force generating a transverse reaction directed inwardly of the curve to maintain the body in a central position relative to the bogies, wherein said transducer means comprise two accelerometers placed in proximity of the opposite ends of the vehicle, and further comprising an electronic processing unit operatively connected to said two accelerometers and to said valve means and generating electrical piloting signals proportional to the non-compensated centrifugal acceleration for piloting correspondingly said valve means, wherein the electronic processing unit is adapted to be set so as to selectively pilot the said valve means according to each of the following modes:

the piloting signals of the valve means associated to the jacks of each bogie are solely a function of the signals provided by the accelerometer placed at the end of the vehicle corresponding to the respective bogie;

the piloting signals of the valve means associated to the jacks of the two bogies are a function of a weighted average of the signals provided by the two accelerometers;

the piloting signals of the valve means associated to the jacks of the two bogies are both a function of the signals provided by the accelerometer placed at one end of the vehicle;

the piloting signals of the valve means associated to the jacks of the two bogies are both a function of the signals provided by the accelerometer placed at the other end of the vehicle.

2. Apparatus according to claim 1, wherein the electronic processing unit is arranged to produce electrical piloting signals of said valve means by weighting and mixing the signals of said accelerometers as a function of the characteristics of the railway vehicle.

3. Apparatus according to claim 1, wherein the two accelerometers are applied onto the ends of the body the vehicle.

4. Apparatus according to claim 1, wherein said valve means are electronic proportional valves.

5. Apparatus according to claim 1, wherein said valve means are electronic servo valves.

6. A railway vehicle comprising a body having opposite ends, two bogies placed in proximity of the body ends and having respective opposite sides, vertical and lateral suspension means between the body and the two bogies, and an anticentrifugal active lateral suspension apparatus for balancing non-compensated centrifugal acceleration during travel of the vehicle along a railway curve, said anticentrifugal apparatus comprising a source of fluid under pressure, fluid pressure jacks interposed transversely between the body and the opposite sides of each bogie, valve means for connecting alternatively said jacks with the said source or fluid under pressure, and transducer means adapted to detect the non-compensated centrifugal acceleration and to produce corresponding piloting signals for said valve means so as to apply, by means of said jacks, a force contrasting the centrifugal force acting on the body, wherein said transducer means comprise two accelerometers placed in proximity of the opposite ends of the vehicle, and said anticentrifugal apparatus further comprising an electronic processing unit operatively connected to said two accelerometers and to said valve means and generating electrical piloting signals proportional to the non-compensated centrifugal acceleration for piloting correspondingly said valve means, wherein the electronic processing unit is adapted to be set so as to selectively pilot the said valve means according to each of the following modes:

the piloting signals of the valve means associated to the jacks of each bogie are solely a function of the signals provided by the accelerometer placed at the end of the vehicle corresponding to the respective bogie;

the piloting signals of the valve means associated to the jacks of the two bogies are a function of a weighted average of the signals provided by the two accelerometers;

the piloting signals of the valve means associated to the jacks of the two bogies are both a function of the signals provided by the accelerometer placed at one end of the vehicle;

the piloting signals of the valve means associated to the jacks of the two bogies are both a function of the signals provided by the accelerometer placed at the other end of the vehicle.

7. A railway vehicle according to claim 6, wherein the two accelerometers are applied onto the ends of the body of the vehicle.

8. A railway vehicle according to claim 6, wherein said valve means are electronic proportional valves.

9. A railway vehicle according to claim 6, wherein said valve means are electronic servo valves.

* * * * *